US005170915A

United States Patent [19]

Szadkowski

[11] Patent Number: 5,170,915

[45] Date of Patent: Dec. 15, 1992

[54] SEALABLE CASTING DEVICE FOR METALLURGICAL CONTAINER

[75] Inventor: Stan Szadkowski, Marly, Switzerland

[73] Assignee: International Industrial Engineering S.A., Braine l'Alleud, Belgium

[21] Appl. No.: 659,293

[22] PCT Filed: Aug. 17, 1990

[86] PCT No.: PCT/BE90/00046

§ 371 Date: Jun. 14, 1991

§ 102(e) Date: Jun. 14, 1991

[87] PCT Pub. No.: WO91/03339

PCT Pub. Date: Mar. 21, 1991

[30] Foreign Application Priority Data

Aug. 30, 1989 [BE] Belgium ..... 08900926

[51] Int. Cl.[5] ..... B22D 41/22

[52] U.S. Cl. ..... 222/600; 222/606; 266/236

[58] Field of Search ..... 222/600, 597, 591, 606; 266/236

[56] References Cited

U.S. PATENT DOCUMENTS 4,415,103 11/1983 Shapland et al. ..... 222/600

4,887,748 12/1989 Hicks ..... 222/606

FOREIGN PATENT DOCUMENTS 2158380 11/1985 United Kingdom ..... 222/600

*Primary Examiner*—Scott Kastler

*Attorney, Agent, or Firm*—Ladas & Parry

[57] ABSTRACT

A sealing device is mounted to slide against the underside of a fixed plate, to allow liquid metal contained in the container to flow out, or to block the casting passage. A fixed reference plate is mounted against the underside of the sealing device, the underside of the reference plate is placed against the upper surface of a bearing plate, and the reference plate comprises a casting opening placed coaxially to the casting channel of the external casting pipe. The whole device is held together by clamping means.

7 Claims, 3 Drawing Sheets

SEALABLE CASTING DEVICE FOR METALLURGICAL CONTAINER

The present invention relates to a pouring device for a steel or metal container such as a continuous pouring distributor or a pouring ladle.

A pouring device comprises elements of refractory material traversed by a pouring duct which terminates in an outer tube known as an external spout. When the molten metal is poured the refractory wall of the pouring duct and of the outer spout erodes considerably under the effect of the high temperature of the liquid metal and, in particular, the external spout must be replaced frequently. It is for this reason that a means is provided so that the external spout may be replaced as quickly as possible so as to fully reduce the immobilization time of the container and in particular in the case of the continuous pouring.

The European patent 0192019 describes a feeding and exchange device for the outer pouring tube in a pouring device, as a result of which the external spout can be replaced rapidly. The external spout is attached to a movable base of refractory material, this movable base being placed under a fixed plate of refractory material which is pierced with a pouring aperture and fastened to the base of the container. A spring mechanism pushes upwards on the base which carries and clamps the base of the external spout against the fixed plate which serves as a reference plate. The aim of the present invention is to provide the feeding and exchange device for the pouring tube briefly described hereabove with a movable element which enables the pouring pipe to be sealed off between the container and the outer spout. A sealing element of this type is certainly known per se and consists of a plate of refractory material pierced with at least one pouring aperture and mounted in such a way that it can slide by means of translation or rotation with respect to the fixed plate. In the known devices the sliding plate which serves as a seal is mounted against the fixed plate in such a way that it can slide on the contact surface of the fixed plate whilst ensuring that perfect impermeability is achieved. This assembly is usually achieved by pushing the movable plate against the fixed plate which serves as a reference plate for the whole of the device.

The use of a sliding seal placed in the known way with a feeding and exchange device for the pouring tube according to the precited European patent 0192019 would pose a problem of impermeability between the seal and the movable tube carrier base. In addition, a construction of this type would render the use of a pouring tube or external spout with adjustable output difficult.

The present invention solves the problem using a pouring device which may be sealed comprising a fixed refractory plate which is attached under the base of the container and pierced with a pouring aperture co-axial to the pouring duct of the container, and a plate serving as a base for an external pouring tube, which device is noteworthy in that it comprises in addition a seal placed in such a way that it slides against the lower side of the fixed plate so as to assume a position which allows the metal liquid contained in the container pass through or assume a position which seals the pouring passage; a fixed reference plate mounted against the lower side of the seal, the lower side of the reference plate being placed against the upper side of the base plate, and the reference plate being pierced with a pouring aperture which is co-axial to the pouring duct for the external pouring tube. Clamping means are provided in order to push and maintain the base plate against the lower side of the reference plate and in order to push the fixed plate and the seal towards the reference plate and to maintain the clamped seal against the upper side of this reference plate. The advantage of the invention is that a movable external spout with adjustable output can be provided.

BRIEF DESCRIPTION OF THE DRAWINGS

The invention is shown in detail in the following using the enclosed diagrams.

Figure 1:
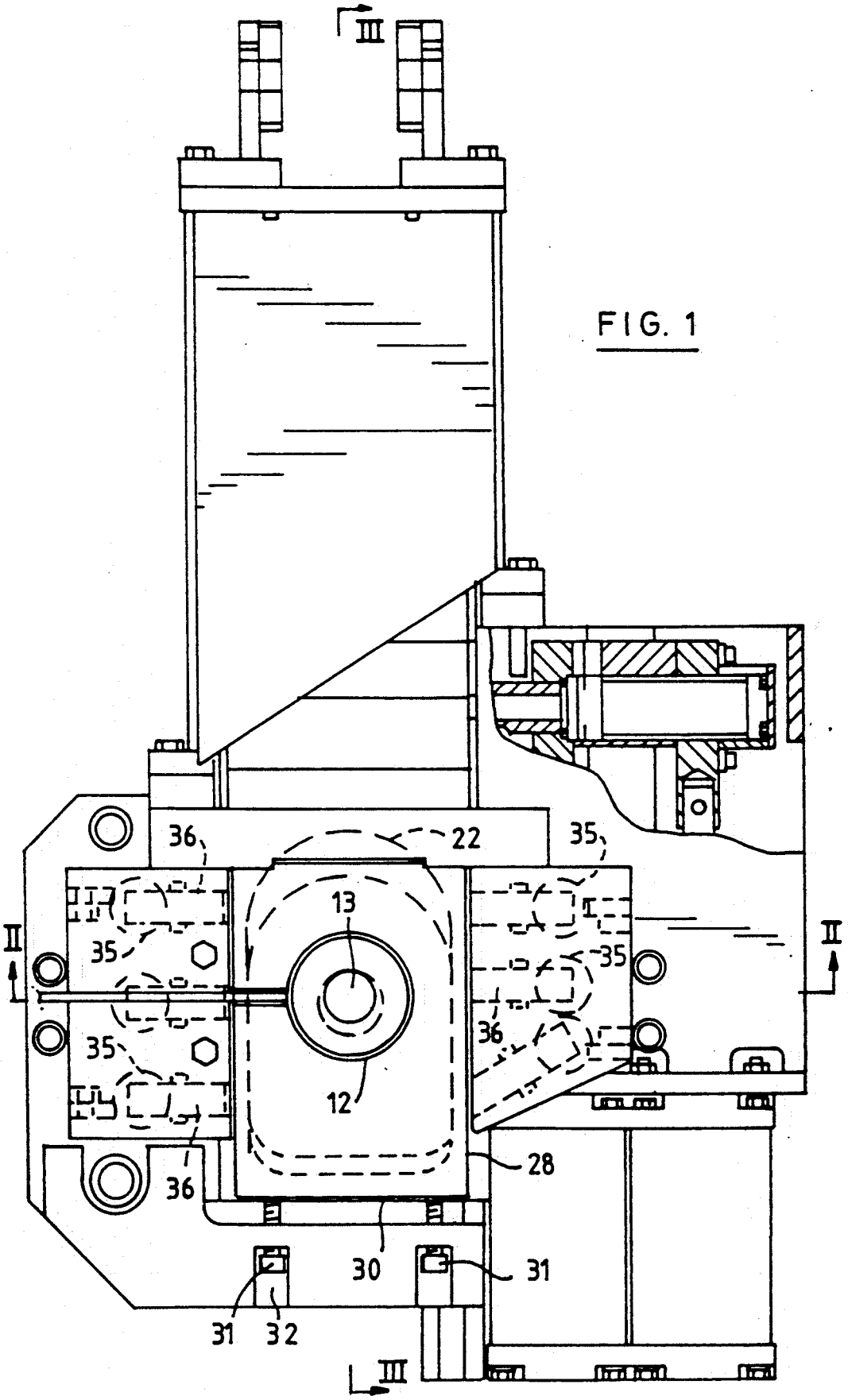
FIG. 1 is a plan view of a pouring device according to the invention.

The embodiment illustrated by way of example represents a pouring device for a continuous pouring distributor. The base of the distributor is designated by the reference number 10 in FIG. 2. The reference number 12 designates the internal spout which, as is known, is housed in a seating brick 11 which is laid in the inner refractory coating of the distributor. The lower end of the internal spout 12 is fitted in a groove formed on the upper side of a plate 21 of refractory material (known as a fixed plate) pierced with a pouring aperture 14 which is co-axial to the pouring duct 13 of the internal spout 12. The fixed plate 21 is attached in a support ring 28 maintained in a chamber 20 as will subsequently be seen.

Figure 2:
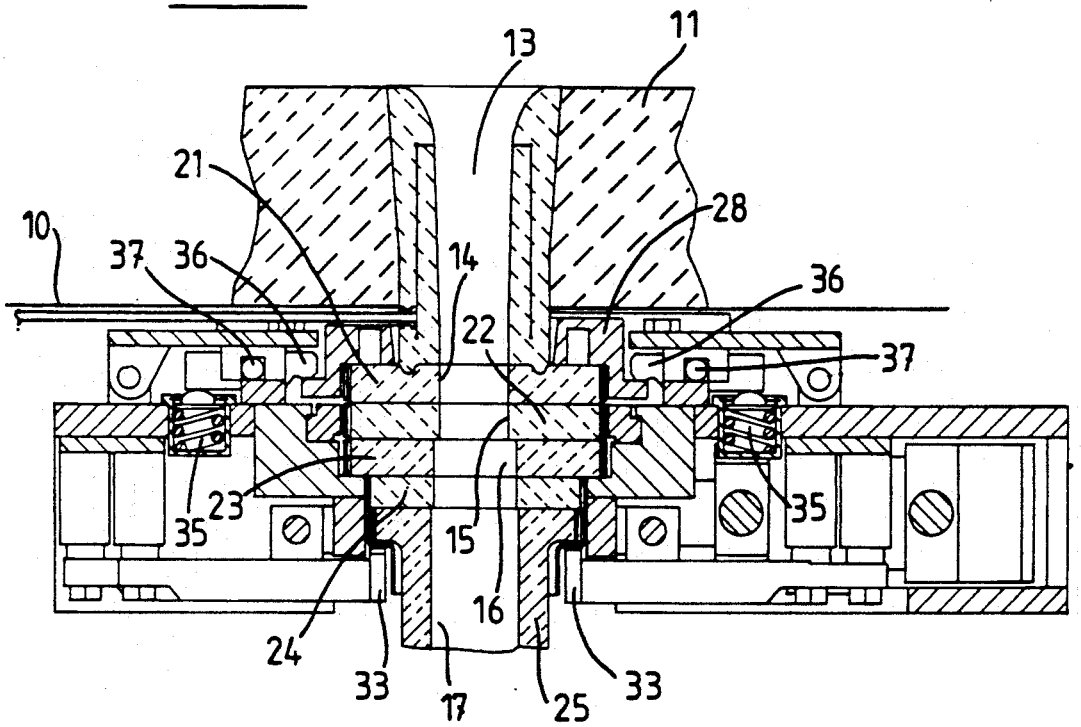
FIG. 2 is a sectional view along the line II—II of FIG. 1.

Under the fixed plate 21 there is placed a movable plate 22 of refractory material pierced with a pouring aperture 15 which, in the position shown in FIG. 2, is co-axial to the pouring aperture 14 of the fixed plate 21. The movable plate 22 is mounted in such a way that it can slide along the fixed plate 21 in the direction indicated by the arrow M in FIG. 3 (i.e. the direction perpendicular to the plane in the diagram in FIG. 2) under the action of a thrusting arm 27 controlled by a driving mechanism known per se. When it is moved by sliding along the fixed plate 21, the movable plate 22 seals the pouring duct.

Underneath the movable plate 22 which serves as a sliding seal there is placed a fixed plate 23 of refractory material which is pierced with a pouring hole 16 which communicates with the pouring apertures 14 and 15 and the pouring duct 13. The plate 23 is attached in a rigid manner to the chamber 20 as is shown in particular in FIG. 3. The fixed plate 23 serves as a reference plate for mounting the device as will subsequently be seen.

Against the reference plate 23 there is placed a base 24 which is made integral with a pouring tube 25 or an external spout. The base-spout assembly is put into place by means of horizontal translation using a thrusting arm 18 and is maintained by means of arms which form part of the chamber 20. The pouring duct 17 of the external spout 25 communicates with the pouring duct 13 of the internal spout 12.

In the pouring device as described above the intermediary fixed plate 23 between the movable plate 22 and the base 24 of the spout 25 serves as a common reference plate for clamping the device assembly on the inside of the chamber 20. On the one hand the base-spout assembly 24-25 is held and clamped against the lower side of the reference plate 23 by an upward thrust which is exerted by the end of the arms 33 which are reinforced by the action of springs.

On the other hand the fixed plate 21 and the movable plate 22 of the sealing device are held and clamped against the upper side of the reference plate 23 by a downward thrust which is exerted on the support ring 28 which holds the fixed plate 21.

In referring to FIG. 2 it can be seen that the ring 28 is held in position as a result of the pressure of the springs 35 the stress of which is transmitted to the ring by means of pushers 36 which are mounted about a pivot shaft 37. In the illustrated embodiment the springs 35 and the pushers 36 are 6 in number. A screw 31 (which can be seen in FIG. 3) exerts on the ring 28 a stress which has a vertical component; this produces a low downward pressure which enables the ring 28 to be stabilised whilst the movable plate 22 is sliding.

As a result of this device according to the invention the fixed plate 21 is situated in a perfectly stable manner thus avoiding any lateral or vertical movement of this plate without it being necessary to increase the clamping force.

Figure 3:
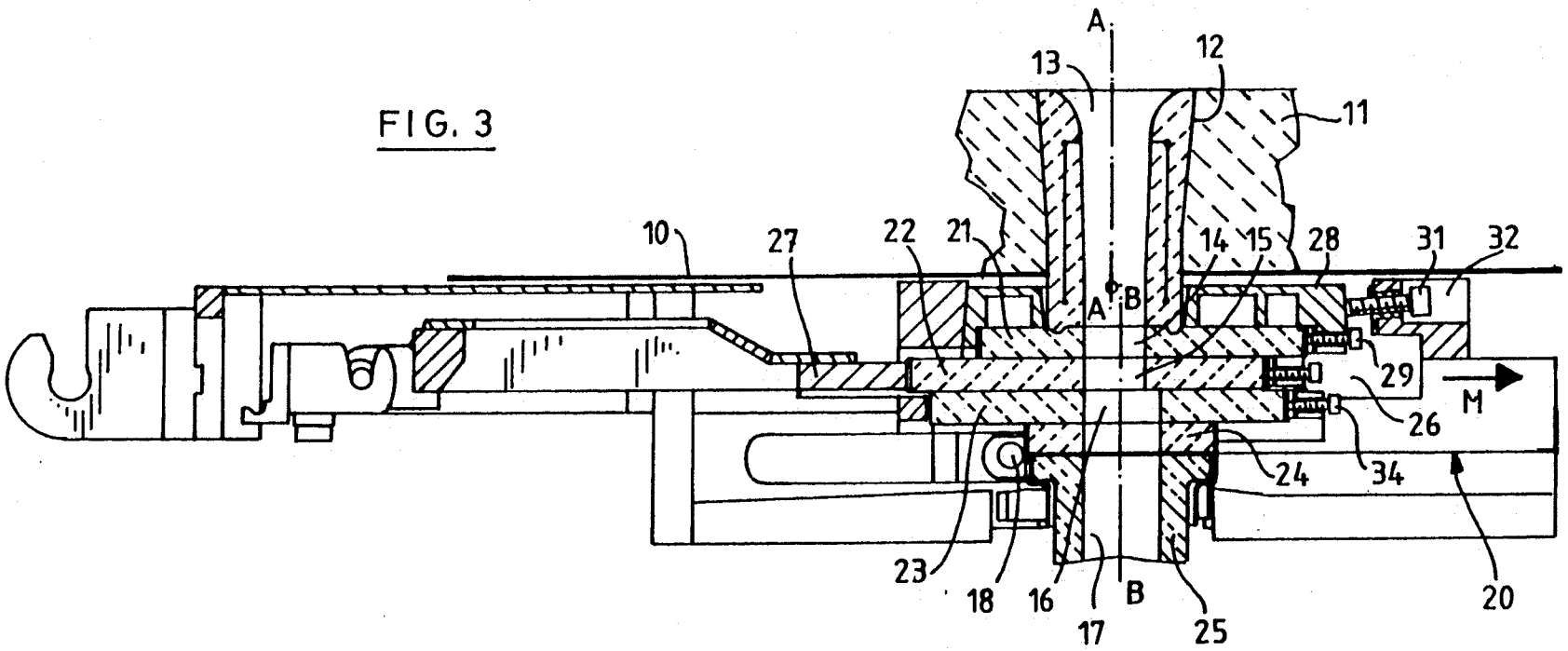
FIG. 3 is a sectional view along the line III—III of FIG. 1.

In addition, the device according to the invention advantageously enables an external spout with adjustable output to be used. FIG. 3 shows by way of example an embodiment in which the axis B—B of the spout 25 and of the aperture of the reference plate 23 is offset with respect to the axis A—A of the pouring duct 13 of the internal spout 12. A screw 34 enables the horizontal position of the reference plate 23 to be blocked so as to maintain it in position while the movable plate is moving whilst ensuring that excellent impermeability is achieved.

The embodiment described above is an example given by way of illustration to which the invention is not limited. All modifications, variants and equivalent arrangements must be considered as being included within the scope of the invention.

I claim:

1. A pouring device for a steel or metal container having an internal spout with a pouring duct, comprising:

a fixed refractory plate which is fixed under a base of the container, the fixed refractory plate having a pouring aperture defined therein which is coaxial with the pouring duct of the container;

a slidable plate, having an aperture defined therein, mounted to a bottom side of said fixed plate so that said slidable plate is moveable between a first position in which metal liquid contained in the container can passes through said aperture in said sliding plate and a second position in which the metal liquid is prevented from passing through the aperture in said slidable plate;

a fixed reference plate rigidly mounted in a chamber means of said container, said fixed reference plate positioned against a bottom side of the slidable plate and having a pouring hole defined therein which is in fluid communication with said pouring duct when said slidable plate is in said first position;

a base-spout assembly having a base plate, positioned against a bottom side of said fixed reference plate, and an external spout, extending from said base plate, having an exit pouring duct coaxial with the pouring hole in said fixed reference plate; and a first clamping means to urge the base-spout assembly against the bottom side of the fixed reference plate and a second clamping means to urge the fixed plate and the slidable plate towards a top side of said fixed reference plate.

2. A device according to claim 1, wherein a fixed plate is fixed in a support ring so that a vertically directed pressure can be exerted on the support ring by said second clamping means so as to clamp the fixed and slidable plates against the fixed reference plate.

3. A device according to claim 2, wherein the support ring has an oblique lateral flank on which a stability means exerts a force on said support ring which has a vertical component directed towards the fixed reference plate so as to stabilize the support ring and the fixed plate when the slidable plate is moved between said first and second positions.

4. A device according to claim 1, wherein the first clamping means includes resiliently biased arms, within the chamber, that abut said base-spout assembly and urge the base-spout assembly against the bottom side of the fixed reference plate, and wherein said second clamping means includes pivotally mounted resiliently biased arms which abut said support ring and urge the supporting ring, fixed plate and slidable plate towards said fixed reference plate.

5. A device according to claim 1, wherein the longitudinal axis of the pouring hole and the exit pouring duct is offset horizontally with respect to the axis of the pouring duct.

6. A device according to claim 2, wherein the longitudinal axis of the pouring hole and the exit pouring duct is offset horizontally with respect to the longitudinal axis of the pouring duct.

7. A device according to claim 3, wherein the longitudinal axis of the pouring hole and the exit pouring duct is offset horizontally with respect to the longitudinal axis of the pouring duct.

* * * * *